US008532529B2

(12) United States Patent
Kageyama et al.

(10) Patent No.: US 8,532,529 B2
(45) Date of Patent: Sep. 10, 2013

(54) FIXING DEVICE AND IMAGE FORMING APPARATUS USING THE SAME

(75) Inventors: Hiroyuki Kageyama, Osaka (JP); Toshiaki Kagawa, Osaka (JP); Shinji Yamana, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 198 days.

(21) Appl. No.: 13/004,103

(22) Filed: Jan. 11, 2011

(65) Prior Publication Data

US 2011/0188904 A1 Aug. 4, 2011

(30) Foreign Application Priority Data

Feb. 4, 2010 (JP) ..... 2010-023234

(51) Int. Cl.
*G03G 15/20* (2006.01)

(52) U.S. Cl.
USPC ..... 399/122; 399/34; 399/323; 399/327

(58) Field of Classification Search
USPC ..... 399/34, 122, 123, 323, 327
See application file for complete search history.

(56) References Cited

U.S. PATENT DOCUMENTS

| | | | | |
|---|---|---|---|---|
| 5,724,638 | A * | 3/1998 | Isogai et al. | 399/333 |
| 5,853,832 | A * | 12/1998 | Ishikawa | 428/36.2 |
| 6,243,559 | B1 | 6/2001 | Kurotaka et al. | |
| 7,509,085 | B2 | 3/2009 | Yoshinaga et al. | |
| 7,715,773 | B2 * | 5/2010 | Ide et al. | 399/327 |
| 2002/0048471 | A1 * | 4/2002 | Ishizuka | 399/325 |
| 2004/0190958 | A1 | 9/2004 | Matsumoto | |
| 2008/0031647 | A1 * | 2/2008 | Yoshikawa | 399/67 |
| 2008/0170896 | A1 * | 7/2008 | Kubota et al. | 399/340 |

FOREIGN PATENT DOCUMENTS

| | | |
|---|---|---|
| JP | 10-213984 | 8/1998 |
| JP | 10-307496 | 11/1998 |
| JP | 2001-075402 | 3/2001 |
| JP | 2002-202683 | 7/2002 |
| JP | 2002-244474 | 8/2002 |
| JP | 2003-076195 | 3/2003 |
| JP | 2004-287131 | 10/2004 |
| JP | 2005-025047 | 1/2005 |
| JP | 2006-201640 | 8/2006 |
| JP | 2006-259299 | 9/2006 |
| JP | 2007-163677 | 6/2007 |
| JP | 2008-129089 | 6/2008 |
| JP | 2008/129089 A * | 6/2008 |
| JP | 2009-265193 | 11/2009 |

* cited by examiner

*Primary Examiner* — Clayton E Laballe
*Assistant Examiner* — Jas Sanghera
(74) *Attorney, Agent, or Firm* — Renner, Otto, Boiselle & Sklar, LLP

(57) ABSTRACT

A fixing device includes a fixing portion provided with a fixing roller, a heating roller and a fixing belt; a pressing roller that presses a recording sheet to the fixing belt; a cleaning unit provided with a cleaning web that cleans up the pressing roller; and a contact/separation mechanism that separates fixing means from the pressing roller. Viscosity of silicone oil that impregnates the cleaning web is set to 3,000 cs or more, and the contact/separation mechanism separates the fixing belt from the pressing roller at the time of rotation operation before fixation.

5 Claims, 5 Drawing Sheets

*FIG. 5*

| | FIXING BELT SURFACE LAYER PFA | SEPARATION OF FIXING BELT FROM PRESSING ROLLER | SILICONE OIL VISCOSITY | FIXATION RANGE | CLEANING PROPERTIES (IMAGE CONTAMINATION) | CONTAMINATION INSIDE DDEVICE | JUDGMENT |
|---|---|---|---|---|---|---|---|
| EXAMPLE 1 | TUBE | PRESENT | 3,000cs | 40°C | 200 k OR MORE | ○ | ○ |
| EXAMPLE 2 | COATED | PRESENT | 3,000cs | 50°C | 200 k OR MORE | ○ | ○ |
| COMPARATIVE EXAMPLE 1 | TUBE | PRESENT | 300cs | 40°C | IMAGE CONTAMINATION OCCURS IN THE CASE OF 10 k | × | × |
| COMPARATIVE EXAMPLE 2 | TUBE | ABSENT | 3,000cs | 25°C OR LESS | IMAGE CONTAMINATION OCCURS IN THE CASE OF 5 k IMAGE QUALITY IS DEGRADED DUE TO DEFECTS OF PEELING PROPERTIES | ○ | × |

FIXING DEVICE AND IMAGE FORMING APPARATUS USING THE SAME

This Nonprovisional application claims priority under 35 U.S.C. §119(a) on Patent Application No. 2010-023234 filed in Japan on 4 Feb. 2010, the entire contents of which are hereby incorporated by reference.

BACKGROUND OF THE INVENTION

1. Field of the Invention

The present invention relates to a fixing device used for an image forming apparatus such as a laser beam printer, a multi-functional peripheral or the like and an image forming apparatus using the same, and particularly, relates to a fixing device including fixing roller that fuses an unfixed toner to fix to a recording medium and an image forming apparatus using the same.

2. Description of the Prior Art

Conventionally, as a fixing device used for an electrophotographic image forming apparatus such as a multi-functional peripheral, a printer or the like, a fixing device employing a so-called heat-roller fixing type is widely used.

The fixing device employing the heat-roller fixing type includes a pair of rollers (a fixing roller and a pressing roller) in press-contact with each other, and after the pair of the rollers is heated to a predetermined temperature (fixing temperature) by a heating portion composed of a halogen heater and the like arranged inside both rollers of the pair of the rollers or either one of the rollers, a recording medium such as a recording sheet on which an unfixed toner image is formed is fed to a press-contact portion (fixing nip portion) of the pair of the rollers to pass through the press-contact portion so that the toner image is fixed on the recording sheet by heat and pressure.

Incidentally, in the fixing device provided in a color image forming apparatus, an elastic roller provided with an elastic layer made of silicone rubber and the like is generally used on a fixing roller surface layer in contact with an unfixed toner image.

The elastic roller is used for the fixing roller, and the fixing roller surface is thereby elastically deformed corresponding to unevenness of the unfixed toner image to come in contact with the surface of the toner image so as to cover, so that it becomes possible to perform favorable heating and fixation for an unfixed color toner image having a larger amount of the toner compared to that of an unfixed monochrome toner image.

Further, the color image forming apparatus using the elastic roller as the fixing roller is able to improve a strain release properties with respect to a color toner which is easily subjected to offset compared to a monochrome toner due to a strain release effect of the elastic layer of a fixing nip portion.

Moreover, the color image forming apparatus has the fixing nip portion whose nip shape becomes a protruded shape toward the fixing roller side (what is called, an inverse nip shape), which makes it possible to improve peeling performance of a recording sheet, and to allow the recording sheet to be peeled off without using a peeling portion such as a peeling claw (self-stripping), so that it is possible to remove an image defect caused by the peeling portion.

Additionally, in order to form a color image forming apparatus corresponding to recent higher processing speed, the fixing device provided in the color image forming apparatus needs to be configured so as to form a fixing nip portion having a wide nip width. Methods of widening the nip width of the fixing nip portion include a method of thickening a layer thickness of the elastic layer of the fixing roller, a method of enlarging a fixing roller diameter and the like.

However, since the elastic layer provided in the fixing roller has very low heat conductivity, a problem arises such that a surface temperature of the fixing roller does not move on with increase in the processing speed in a case where the heating portion is inside the fixing roller.

On the other hand, a problem arises such that a larger fixing roller diameter requires a longer warming-up time until the surface temperature of the fixing roller reaches the fixing temperature and increased power consumption.

In order to solve the above-described conventional problems, a belt fixing type fixing device using a fixing belt is disclosed as a fixing device provided in a color image forming apparatus (refer to Patent Literature 1).

The belt fixing type fixing device has no heating portions provided in a fixing roller and a pressing roller; includes a heating roller separately from the fixing roller and the pressing roller; has a fixing belt suspended between the heating roller and the fixing roller; has the pressing roller facing the fixing roller via the fixing belt; and is configured such that the fixing belt is heated with a heat source arranged inside the heating roller.

In the belt fixing type fixing device, a fixing nip portion is formed in a press-contact part where the fixing roller comes into press-contact with the pressing roller via the fixing belt. Such a belt fixing type fixing device is configured so that the fixing belt whose heat capacity is small is heated, and it is thus possible to shorten the warming-up time until the surface temperature of the fixing belt reaches the fixing temperature.

Further, the belt fixing type fixing device does not need to arrange a heating portion such as a halogen heater inside the fixing roller, and the fixing roller provided with a thick elastic layer with low hardness made of sponge rubber or the like is able to be used, so that it is possible to form the fixing nip portion with a wide nip width.

In this manner, the belt fixing type fixing device is, since boot speed is fast, allowed to have no preheating during ready and waiting as well as to shorten a waiting time, and is provided in an image forming apparatus of not only a miniature low-speed machine but also a large machine and a high-speed machine.

Next, description will be given for cleaning of the fixing roller of the above-described fixing device.

First, description will be given in detail for an example of a conventional fixing device that does not use a fixing belt with reference to the drawings.

FIG. 1 is an illustrative diagram showing a configuration of the conventional fixing device that does not use the fixing belt.

A conventional fixing device 150 is provided with, as shown in FIG. 1, for example, a cleaning device 160 using a cleaning web 161 (hereinafter, simply referred to as "web") in addition to a fixing roller 151 and a pressing roller 152.

The fixing roller 151 is provided with heating portions 151*a* and 151*b*. The pressing roller 152 is provided with a heating portion 152*a*. The fixing roller 151 and the pressing roller 152 which are configured in this manner are brought into press-contact with each other so that a fixing nip 153 is formed. A recording sheet 32 on which an unfixed toner image T0 is formed passes through the fixing nip 153 between the fixing roller 151 and the pressing roller 152, thereby fusing an unfixed toner to be fixed onto the recording sheet 32.

The cleaning device 160 is provided with a web 161, a delivery roller 162, a wind-up roller 163 and a press-contact roller 164.

The web 161 is impregnated with anti-toner-adhesive oil, and comes into contact with the surface of the fixing roller 151, thereby adsorbing and removing a toner that adheres to the surface of the fixing roller 151 as well as applying the anti-toner-adhesive oil to the surface of the fixing roller 151.

The delivery roller 162 is rotatably provided to deliver the web 161. The wind-up roller 163 is rotatably provided to be delivered from the delivery roller 162 and rewinds the cleaning web 161 after coming into contact with the fixing roller 151.

The press-contact roller 164 is rotatably provided and brings the web 161 into press-contact with the surface of the fixing roller 151. That is, the web 161 is held between the fixing roller 151 and the press-contact roller 164. A press-contact portion between the fixing roller 151 and the web 161 thus becomes a cleaning nip portion 165.

In the conventional fixing device 150, the web 161 is delivered from the delivery roller 162, passes through the cleaning nip portion 165, and is rewound by the wind-up roller 163. Subsequently, the web 161, at the time of passing through the cleaning nip portion 165, removes a toner that adheres to the surface of the fixing roller 151 as well as applies the oil to the surface of the fixing roller 151.

In this manner, the fixing device 150 becomes a favorable state since the surface of the fixing roller 151 is cleaned up by the cleaning device 160.

Next, description will be given for a conventional belt fixing type fixing device using a fixing belt.

In a fixing device using a fixing belt with low heat capacity, since heat storage performance from a heater to the fixing belt are smaller compared to a heat quantity that shifts from the fixing belt to the recording sheet, when the surface temperature of the fixing belt and the pressing roller is lowered and is not maintained in an appropriate temperature range, an offset amount (amount to be transferred to the fixing belt) of the toner is increased more than usual, and a problem that the fixing belt is contaminated easily occurs. Such a problem tends to occur notably when an image with a high halftone print rate is printed in large quantity.

Additionally, when image formation is performed using the above-described belt fixing method, the surface of the fixing belt is charged by combining the fixing belt and the pressing roller, and a phenomenon occurs such that the surface of the fixing belt attracts the toner from the recording sheet (what is called, electrostatic offset) in some cases.

When the electrostatic offset occurs, the toner is retransferred onto the recording sheet and comes up to the surface as a remained image after the fixing belt goes around, or a large amount of the toner adheres to a cleaning member (for example, cleaning roller) that is brought into contact with the fixing belt in order to prevent such a case, and the toner that once adheres to the cleaning member is thereby fused (melted) again to adhere to the fixing belt, then a phenomenon that contaminates the recording sheet occurs in some cases.

Moreover, there is a problem that since the temperature of the pressing roller is lower than the temperature of the fixing belt, the toner that adheres to the fixing belt (offset toner) moves to the surface of the pressing roller and adheres to the peeling claw to cause image contamination on the recording sheet.

In this manner, there is a case where a toner or an offset toner of an unfixed toner image is adhered to the surface of the fixing belt. The toner that adheres to the fixing belt is fixed to another recording sheet and recognized as image contamination or the like. Therefore, various measures are employed in order to prevent the toner from adhering to the surface of the fixing belt or to remove the toner that adheres to the surface of the fixing belt.

For example, a fixing device, in order to remove the offset toner, brings the pressing roller into contact with a roller applied with a slight amount of oil, and brings the roller applied with oil into contact with the cleaning roller that cleans up the surface thereof is disclosed (refer to Patent Literature 2).

As another example, a fixing device is disclosed that, in an image heating device that includes a heating member, a pressing member brought into press-contact therewith and a cleaning member arranged facing the pressing member, and performs heat-processing of a toner image by guiding a recorded material that carries the toner image to be held and conveyed by a press-contact nip portion formed with the heating member and the pressing member, includes a cleaning member contact/separation portion that, in order to clean up the offset toner caused by lowering of the temperature of the pressing roller, uses a metallic roller whose surface energy is higher than that of the pressing roller, and brings the cleaning member into contact with/separation from the pressing member corresponding to a type of the recorded member (refer to Patent Literature 3).

Further, a fixing device is disclosed that includes a fixing member arranged on the side of a toner image of a recording medium that carries the toner image and a pressing member arranged on the side of a non-toner image of the recording medium, and fixes the toner image to the recording medium by heating and pressing the toner of the toner image when the recording medium that carries the toner image passes through between the fixing member and the pressing member, and includes a variable mechanism that varies the distance between the fixing member and the pressing member, and a cleaning member that comes into contact with the pressing member when the fixing member is placed at a position where the fixing member separates from the pressing member to clean up the pressing member (refer to Patent Literature 4).

PRIOR ART LITERATURES

Patent Literature 1: Japanese Patent Application Laid-open Hei 10 No. 307496

Patent Literature 2: Japanese Patent Application Laid-open No. 2006-201640

Patent Literature 3: Japanese Patent Application Laid-open No. 2001-75402

Patent Literature 4: Japanese Patent Application Laid-open No. 2008-129089

However, in the cleaning device using the roller applied with oil that is disclosed in Patent Literature 2, viscosity of oil that impregnates the cleaning roller is low viscosity (for example, 300 cs (centistoke) or less), and there is no adverse effect on peeling properties of the recording medium even though using a PFA (tetrafluoroethylene perfluoroalkyl vinyl ether copolymer) tube excellent in durability on the surface layer of the fixing belt, however, there has been a problem that the cleaning performance is retarded.

Additionally, there is an issue that since silicone oil with low viscosity is used, silicone oil contamination inside the device occurs due to dripping in the case of a high temperature.

Further, in the fixing device that brings the cleaning roller into contact with/separation from the pressing roller that is disclosed in Patent Literature 3, there is an issue that contamination of the cleaning roller is prevented from retransferring to the pressing roller, however, silicone oil with only low viscosity is able to be impregnated with the cleaning roller, thus the contamination inside the device occurs due to dripping as mentioned above.

On the other hand, in a cleaning device using a cleaning web, there is a need for use of silicone oil with relatively high viscosity (for example, 3,000 cs or more) as viscosity of the oil that impregnate the cleaning web in order to prevent the silicone oil from dripping from the cleaning web.

In this case, a large amount of silicone oil moves from the surface of the pressing roller to the fixing belt at the time of rotation before fixation of the fixing belt and the pressing roller before the recording medium passes through the fixing nip portion. There has been an issue that in a case where the surface layer of the fixing belt is formed of the PFA tube, there is great adhesive force between the silicone oil that adheres to the tube and the toner on the recording sheet so that peeling properties of the recording medium are extremely deteriorated. Here, the rotation before fixation means that the fixing belt and the pressing roller are rotated so that the fixing device becomes a fixable state before performing fixation operation at a fixing step (warming-up operation).

Furthermore, when a large amount of the silicone oil adheres to the surface of the fixing belt, the peeling properties of the recording medium are deteriorated due to adhesive strength of the silicone oil, a fixable temperature range narrows, and high-temperature offset occurs to cause image degradation.

Consequently, a technology that brings the cleaning member into contact with/separation from the pressing roller is considered in order to have an appropriate silicone oil amount on the surface of the fixing belt according to a type of the recording medium, however, it is difficult to manage whether an oil amount on the surfaces of the fixing belt and the pressing roller is an appropriate amount, and it is unadaptable to miniaturization since the mechanism is complicated.

Additionally, in Patent Literature 4, the pressing roller is brought into contact with the cleaning roller when the fixing belt separates from the pressing roller, thereby attempting prevention of image degradation and a longer operating life of the cleaning roller. However, even though the fixing belt comes into contact with/separation from the pressing roller employing a pressure release mechanism used as a pressure strain countermeasure of the fixing member, a contact/separation mechanism of the cleaning roller with/from the pressing roller becomes a complicated structure in order to correspond to position movement of the pressing roller, and has problems of high cost, a larger-size fixing device and the like.

SUMMARY OF THE INVENTION

The present invention has been devised in view of the above-described conventional problems, and aims to provide a fixing device having a simple configuration that maintains a fixation range of a recording medium, allows the recording medium to have favorable peeling properties without contamination inside the device due to cleaning oil, and is able to form a uniform and high quality image, and an image forming apparatus using the same.

The fixing device and the image forming apparatus using the same according to the present invention in order to solve the above-described issues are provided as follows.

A first aspect of the present invention is that a fixing device that fixes an unfixed toner image to a recording medium while conveying the recording medium includes a fixing portion, a pressing roller, a cleaning portion and a contact/separation mechanism; wherein the fixing portion is provided with a fixing roller so as to rotate freely, a heating roller, and a fixing belt that is looped over the fixing roller and the heating roller and heats and fuses the unfixed toner image on the recording medium to fix onto the recording medium; the pressing roller is provided at a position facing the fixing roller via the fixing belt so as to rotate freely and conveys the recording medium while pressing to the fixing belt; the cleaning portion comprises a cleaning member impregnated with silicone oil that comes into contact with the pressing roller to clean up the pressing roller; the contact/separation mechanism brings the fixing portion into contact with/separation from the pressing roller; viscosity of the silicone oil is 3,000 cs (centistoke) or more; and the contact/separation mechanism separates the fixing belt and the pressing roller while preliminary rotation of the fixing belt and the pressing roller in preparatory operation before fixing (for example, at the time of warming-up).

Further, a second aspect of the present invention is that the fixing belt has a multilayered structure, and the surface layer of the fixing belt is formed of a fluororesin tube.

Further, a third aspect of the present invention is that the cleaning member is formed of a web material made of a heat-resistant nonwoven fabric.

Further, a fourth aspect of the present invention is that the cleaning portion is composed of a unit comprising a delivery portion that delivers the cleaning member, a wind-up portion that rewinds the cleaning member, and a press-contact roller that is rotatable so as to come into press-contact with the surface of the fixing roller via the cleaning member, and the cleaning portion is configured to be attachable to/detachable from the fixing device.

Further, a fifth aspect of the present invention is that an image forming apparatus that forms an image using a toner with electrophotography is provided with a photoreceptor drum on whose surface an electrostatic latent image is formed, a developing device that supplies a toner to the electrostatic latent image on the surface of the photoreceptor drum to form a toner image, a transfer device that transfers the toner image on the surface of the photoreceptor drum to a recording medium, and a fixing device that fixes the transferred toner image to the recording medium, wherein the fixing devices of any of the aspects 1 to 4 is used as the fixing device.

According to the first aspect of the present invention, viscosity of the silicone oil of the cleaning member is set to 3,000 cs or more, and cleaning performance of an offset toner on the surface of the fixing member thereby becomes favorable so that contamination inside the fixing device due to dripping or the like is able to be prevented in the case of a high temperature.

Moreover, silicone oil with high viscosity is able to suppress disaggregation of the toner once adhered in the cleaning member, and effective cleaning is able to be achieved.

Additionally, the contact/separation mechanism separates the fixing belt from the pressing roller at the time of the rotation operation before fixation (for example, at the time of warming-up), thereby securing a fixable range of the recording medium with a simple configuration to prevent the silicone oil from transferring onto the surface of the fixing belt as well as to prevent adhesion of a large amount of the silicone oil, so that it is possible to seek improvement of peeling properties of the recording medium to obtain a uniform and high quality image.

Note that, viscosity of the silicone oil of the cleaning member is preferably 30,000 cs or less. In the case of exceeding 30,000 cs, an exuding amount of the silicone oil lessens and there is no effect on the cleaning performance. When a coarse fiber mesh is used for the web in order to increase the exuding amount, toner collection performance as a web mechanical function is decreased.

Further, the peeling properties of the recording sheet is retarded when adhesive strength of the silicone oil is too great, the fixable temperature range narrows, and in the case of performing continuous printing, the temperature of the fixing roller is lowered so that the recording sheet is wound around the fixing roller, or a paper jam occurs, posing a problem.

Further, according to the second aspect of the present invention, the fixing belt has a multilayered structure, thereby allowing the fixing belt to have functions of strength, elasticity and release properties, and the surface layer of the fixing belt is formed of a fluororesin tube, thereby securing stable release properties and having favorable durability and abrasion resistance so that it is possible to have a long operating life.

Further, according to the third aspect of the present invention, the cleaning member is formed of a web material made of heat-resistant nonwoven fabric, so that it is possible to realize a cleaning member having high collection efficiency due to adhesion of a toner between fibers and excellent in cleaning performance. Additionally, since silicone oil with high viscosity is able to be used and scattering of the silicone oil is thus suppressed, the silicone oil contamination inside the device is able to be suppressed.

Further, according to the fourth aspect of the present invention, it is easy to change the cleaning member, and parts maintenance cost becomes decreased. Additionally, when the silicone oil contamination by the cleaning member occurs, the contamination is able to be kept inside the unit, and expansion of the contamination is thus able to be prevented.

Further, according to the fifth aspect of the present invention, a fixable range of a recording medium is secured with a simple configuration, the silicone oil is prevented from transferring onto the surface of the fixing belt constituting the fixing device, and adhesion of a large amount of the silicone oil is able to be prevented, so that it is possible to seek improvement of the peeling properties of the recording medium and obtain a uniform and high quality image.

BRIEF DESCRIPTION OF THE DRAWINGS

FIG. 5 is a table comparing effects of examples and comparative examples of the fixing device of the present embodiment.

DESCRIPTION OF THE PREFERRED EMBODIMENTS

Description will be hereinafter given for a mode for carrying out the present invention with reference to the drawings.

Figure 1:
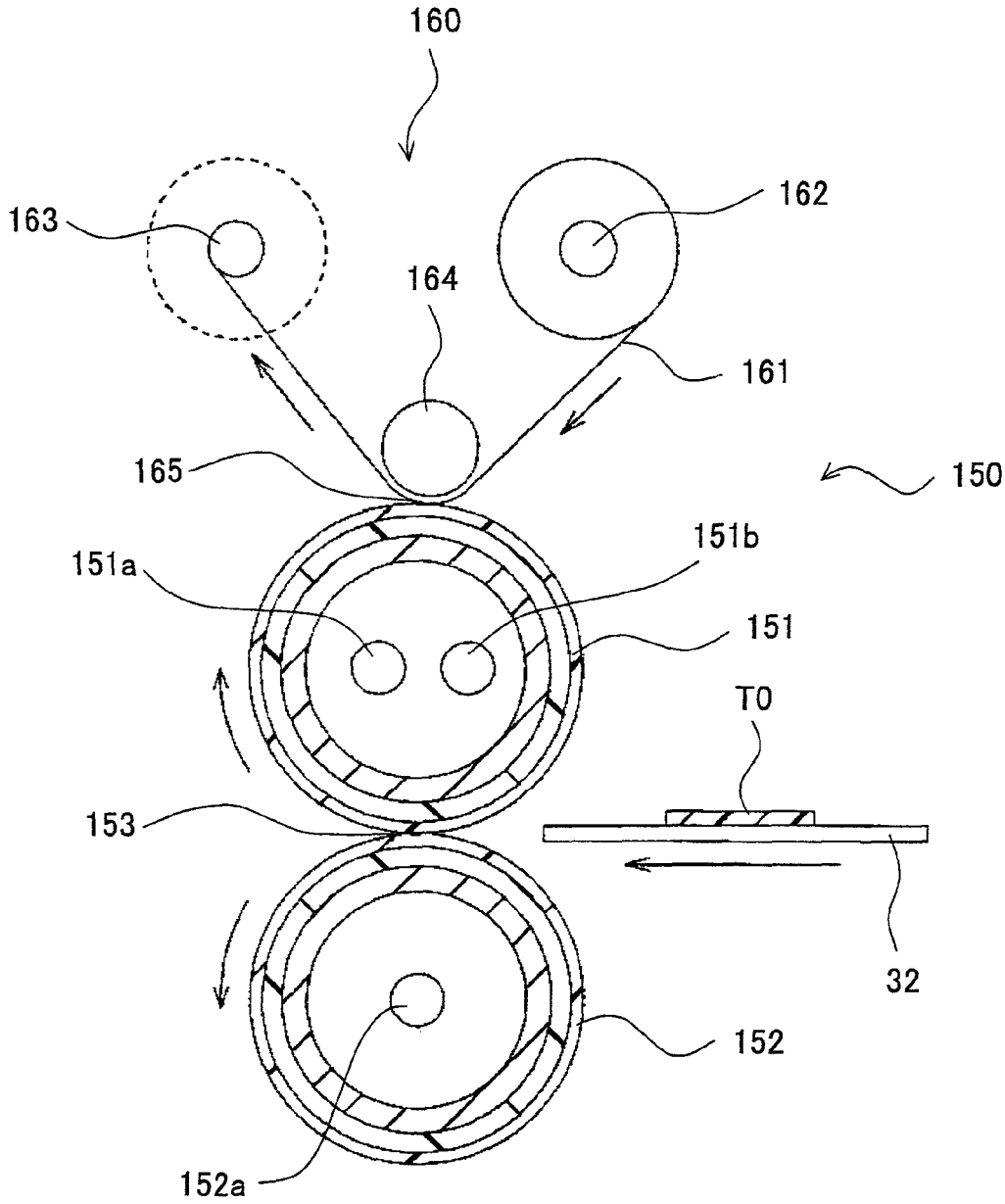
FIG. 1 PRIOR ART
FIG. 1 is an illustrative diagram showing a configuration of a conventional fixing device.
Figure 2:
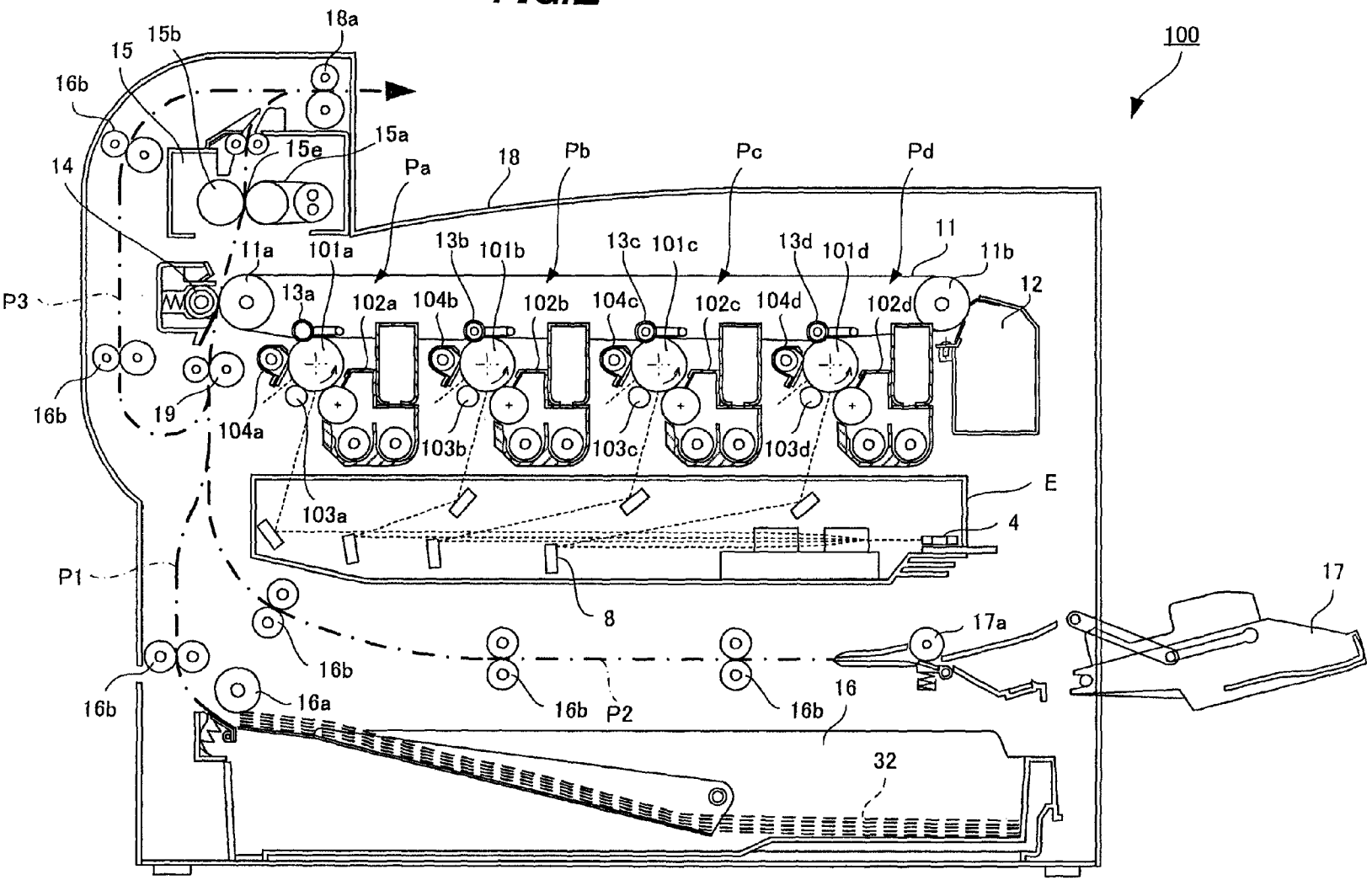
FIG. 2 is an illustrative diagram showing a configuration of the entire image forming apparatus using the fixing device according to an embodiment of the present invention.

FIG. 2 is an example of a mode for carrying out the present invention, and an illustrative diagram showing a configuration of the entire image forming apparatus using a fixing device according to the embodiment of the present invention.

An image forming apparatus 100 according to the present embodiment is provided with, as shown in FIG. 2, photoreceptor drums 101*a* to 101*d* (collectively referred to as "photoreceptor drum 101" in some cases) with an electrostatic latent image formed on the surface thereof, developing devices 102*a* to 102*d* (collectively referred to as "developing device 102" in some cases) that supplies a toner to the electrostatic latent image on the surface of the photoreceptor drum 101 to form a toner image, a secondary transfer roller (transfer device) 14 that transfers the toner image on the surface of the photoreceptor drum 101 via an intermediate transfer belt 11 to a sheet and a fixing device 15 that fixes the transferred toner image to the sheet, and forms an image using a toner with electrophotography.

The image forming apparatus 100 according to the present embodiment forms an image with multi-color and monochrome on a recording sheet 32 based on image data of a read document or image data transmitted via a network or the like.

The image forming apparatus 100 is provided with, as shown in FIG. 2, an exposure unit E, photoreceptor drums 101*a* to 101*d* with a latent image to be formed by the exposure unit E, developing devices 102*a* to 102*d*, charging rollers 103*a* to 103*d* (collectively referred to as "charging roller 103" in some cases), cleaning units 104*a* to 104*d* (collectively referred to as "cleaning unit 104" in some cases), an intermediate transfer belt 11, primary transfer rollers 13*a* to 13*d* (collectively referred to as "primary transfer roller 13" in some cases), a secondary transfer roller 14, a fixing device 15, paper feed paths P1, P2 and P3, a paper cassette 16, a manual paper feeding tray 17 and a paper discharge tray 18.

The image forming apparatus 100 performs image formation at image forming portions Pa to Pd corresponding to each color phase using image data corresponding to each color phase of four colors of black (K), as well as cyan (C), magenta (M) and yellow (Y) as three primary colors of subtractive mixture obtained by color separation of color images.

Each of the image forming portions Pa to Pd has the same configuration, and for example, an image forming portion Pa of black (K) is composed of the photoreceptor drum 101*a*, the developing device 102*a*, the charging roller 103*a*, the primary transfer roller 13*a*, a cleaning unit 104*a* and the like. These image forming portions Pa to Pd are arranged in line in the direction in which the intermediate transfer belt 11 moves (in a vertical scanning direction).

The exposure unit E as an exposure device of the present embodiment is provided with an unillustrated semiconductor laser, a polygon mirror 4, a first reflective mirror, a second reflective mirror 8 and the like, and irradiates each of light beams such as a laser beam modulated according to image data of each color phase of black (K), cyan (C), magenta (M) and yellow (Y) to each of the photoreceptor drums 101*a* to 101*d*. Each of the photoreceptor drums 101*a* to 101*d* forms an electrostatic latent image by image data of each color phase of black (K), cyan (C), magenta (M) and yellow (Y).

In the present embodiment, for the exposure unit E, a method using a laser scanning unit (LSU) including a laser irradiation portion and a reflective mirror is used, however, it is allowed to use a method using, for example, an EL or an LED writing head in which light-emitting devices are arranged in an array.

The photoreceptor drums 101*a* to 101*d* disposed above the exposure unit E are image carriers having approximately cylindrical shapes, and controlled so as to be rotated in a predetermined direction by a driving portion and a control portion which are unillustrated. Additionally, each of the photoreceptor drums 101*a* to 101*d* is configured with a photoconductive layer formed on a base material thereof. For example, a metallic drum produced by aluminum or the like serves as the base material, and on the outer circumferential surface, photoconductive layers such as amorphous silicon (a-Si), selenium (Se), an organic photoconductor (OPC) and the like are formed in a thin film shape. Note that, a configuration of the photoreceptor drum 101 is not particularly limited to the above-described configuration.

The charging roller 103 is a contact-type charger that charges the surface of the photoreceptor drum 101 uniformly to a predetermined potential. In the present embodiment, as shown in FIG. 2, a contact-type roller-type charging roller 103 is used as a charger, however, it is also possible to use a contact-type charger using a charging brush, or a noncontact-type charger using a charged wire.

The developing device 102 supplies a toner as a developer to the surface of the photoreceptor drum 101 having an electrostatic latent image formed thereon to develop the electrostatic latent image to a toner image. Each of the developing devices 102*a* to 102*d* contains a toner of each color phase of black (K), cyan (C), magenta (M) and yellow (Y), and visualizes the electrostatic latent image of each color phase formed on each of the photoreceptor drums 101*a* to 101*d* to a toner image of each color phase.

The cleaning unit 104 removes and collects a toner remained on the surface of the photoreceptor drum 101 after developing and image transfer.

The intermediate transfer belt 11 is arranged above the photoreceptor drum 101, and formed by an endless film with approximately 100 to 150 μm thickness. Then, the intermediate transfer belt 11 is stretched out between a driving roller 11*a* and a driven roller 11*b* to form a looped moving path.

An outer circumferential surface of the intermediate transfer belt 11 faces a photoreceptor drum 101*d*, a photoreceptor drum 101*c*, a photoreceptor drum 101*b* and a photoreceptor drum 101*a*, in this order.

The primary transfer rollers 13*a* to 13*d* are arranged at positions facing each of the photoreceptor drums 101*a* to 101*d* holding the intermediate transfer belt 11 therebetween. The respective positions at which the intermediate transfer belt 11 faces the photoreceptor drums 101*a* to 101*d* are primary transfer positions.

To the primary transfer rollers 13*a* to 13*d*, primary transfer bias having opposite polarity to charging polarity of the toner is applied by constant voltage control in order to transfer the toner images carried on the surfaces of the photoreceptor drums 101*a* to 101*d* onto the intermediate transfer belt 11. Thereby, the toner images of the respective color phases formed on the photoreceptor drums 101*a* to 101*d* are overlapped and transferred onto the outer circumferential surface of the intermediate transfer belt 11 sequentially, and a full-color toner image is formed on the outer circumferential surface of the intermediate transfer belt 11.

However, when image data for only a part of the color phases of yellow (Y), magenta (M), cyan (C) and black (K) is input, electrostatic latent images and toner images are formed at only a part of the photoreceptor drum 101 corresponding to the color phase of the input image data among the four photoreceptor drums 101*a* to 101*d*. For example, during monochrome image formation, formation of an electrostatic latent image and formation of a toner image are performed only at the photoreceptor drum 101*a* corresponding to the color phase of black, and only a black toner image is transferred onto the outer circumferential surface of the intermediate transfer belt 11.

Each of the primary transfer rollers 13*a* to 13*d* is configured by coating the surface of a shaft whose base material is metal such as stainless steel having a diameter of 8 to 10 mm with a conductive elastic material (for example, EPDM (ethylene-propylene diene rubber), urethane foam, etc.) and high voltage is applied uniformly to the intermediate transfer belt 11 by the conductive elastic material. In the present embodiment, although the primary transfer rollers 13*a* to 13*d* are used as transfer electrodes, other than those, a brush or the like is also usable.

The toner image transferred onto the outer circumferential surface of the intermediate transfer belt 11 at each primary transfer position is conveyed to a secondary transfer position which is a position facing the secondary transfer roller 14, by the rotation of the intermediate transfer belt 11.

The secondary transfer roller 14 is in press-contact, at a predetermined nip pressure, with the outer circumferential surface of the intermediate transfer belt 11 whose inner circumferential surface is in contact with a circumferential surface of the driving roller 11*a* at the time of image formation.

When the recording sheet 32 fed from the paper cassette 16 or the manual paper feeding tray 17 passes through between the secondary transfer roller 14 and the intermediate transfer belt 11, high voltage with opposite polarity (+) to the charging polarity of the toner (−) is applied to the secondary transfer roller 14. The toner images are thereby transferred onto the surface of the recording sheet 32 from the outer circumferential surface of the intermediate transfer belt 11.

In this manner, the electrostatic latent images on respective photoreceptor drums 101*a* to 101*d* are visualized by the toner corresponding to each of the color phases to become toner images, respectively, and such toner images are layered on the intermediate transfer belt 11. Thereafter, the layered toner images are moved to a contact position of the conveyed sheet with the intermediate transfer belt 11 by the rotation of the intermediate transfer belt 11, and by the secondary transfer roller 14 arranged in this position, the toner images are transferred from the outer circumferential surface of the intermediate transfer belt 11 onto the recording sheet 32.

Note that, toners remaining on the intermediate transfer belt 11 without being transferred onto the recording sheet 32 among toners adhered from the photoreceptor drum 101 to the intermediate transfer belt 11 are collected by an intermediate transfer belt cleaning unit 12 in order to prevent the colors from mixing at a next step.

In the intermediate transfer belt cleaning unit 12, a cleaning blade as a cleaning member in contact with the intermediate transfer belt 11 is provided. A part of the intermediate transfer belt 11 with which the cleaning blade comes into contact is supported by an intermediate transfer belt driven roller 11*b* from a backside thereof.

The recording sheet 32 to which a toner image is transferred is guided by the fixing device 15 to pass through a fixing nip portion 15*e*, and subjected to heating and pressing. Thereby, the toner image is fixed firmly on the surface of the recording sheet 32. The recording sheet 32 on which the toner image has been fixed is discharged by a paper discharge roller 18*a* onto the paper discharge tray 18. Note that, details of the fixing device 15 will be described below.

Further, the image forming apparatus 100 is provided with a paper conveyance path P1 extending in an approximately vertical direction so that the recording sheet 32 contained in the paper cassette 16 is fed, through between the secondary transfer roller 14 and the intermediate transfer belt 11 and through the fixing device 15, to the paper discharge tray 18.

Arranged in the paper conveyance path P1 are a pick-up roller 16*a* for feeding the recording sheet 32 in the paper cassette 16 into the paper conveyance path P1 sheet by sheet, a conveying roller 16*b* for conveying the fed recording sheet 32 upward, a registration roller 19 for guiding the conveyed recording sheet 32 between the secondary transfer roller 14 and the intermediate transfer belt 11 at a predetermined timing, and the paper discharge roller 18*a* for discharging the recording sheet 32 to the paper discharge tray 18.

In addition, inside the image forming apparatus 100, a paper conveyance path P2 on which a pick-up roller 17*a* and a feed roller 16*b* are arranged is formed between the manual paper feeding tray 17 and the registration roller 19. Further, a paper conveyance path P3 is formed between the paper discharge roller 18*a* and an upstream side of the registration roller 19 in the paper conveyance path P1.

The paper discharge roller 18*a* freely rotates in both forward and reverse directions, and is driven in the forward direction to discharge the recording sheet 32 to the paper discharge tray 18 at the time of single-sided image formation in which an image is formed on one side of the recording sheet 32, and at the time of second side image formation in double-sided image formation in which an image is formed on both sides of the recording sheet 32.

On the other hand, at the time of first side image formation of the double-sided image formation, the paper discharge roller 18*a* is driven in the forward direction until a rear edge of the sheet passes through the fixing device 15, and is then driven in the reverse direction to guide the recording sheet 32 in the paper conveyance path P3 in a state where the rear edge part of the recording sheet 32 is held. The recording sheet 32 on which an image has been formed only on one side at the time of double-sided image formation is thereby guided to the paper conveyance path P1 in a state where the sheet is turned over and upside down.

The registration roller 19 guides the recording sheet 32 that has been fed from the paper cassette 16 or the manual paper feeding tray 17 or has been conveyed through the paper conveyance path P3 between the secondary transfer roller 14 and the intermediate transfer belt 11 at a timing synchronized with the rotation of the intermediate transfer belt 11. Thus, the rotation of the registration roller 19 is stopped when operating of the photoreceptor drum 101 or the intermediate transfer belt 11 is started, and the movement of the recording sheet 32 that has been fed or conveyed prior to the rotation of the intermediate transfer belt 11 is stopped in the paper conveyance path 21 in a state where a front edge thereof comes into contact with the registration roller 19.

Thereafter, rotation of the registration roller 19 is started at a timing when the front edge part of the recording sheet 32 faces a front edge part of a toner image formed on the intermediate transfer belt 11 at a position where the secondary transfer roller 14 is in press-contact with the intermediate transfer belt 11.

Note that, at the time of full-color image formation in which image formation is performed by all of the image forming portions Pa to Pd, the primary transfer rollers 13*a* to 13*d* bring the intermediate transfer belt 11 into press-contact with all of the photoreceptor drums 101*a* to 101*d*.

On the other hand, at the time of monochrome image formation in which image formation is performed only by the image forming portion Pa, only the primary transfer roller 13*a* brings the intermediate transfer belt 11 into press-contact with the photoreceptor drum 101*a*.

Next, description will be given in detail for a configuration of the fixing device 15 with reference to the drawings.

Figure 3:
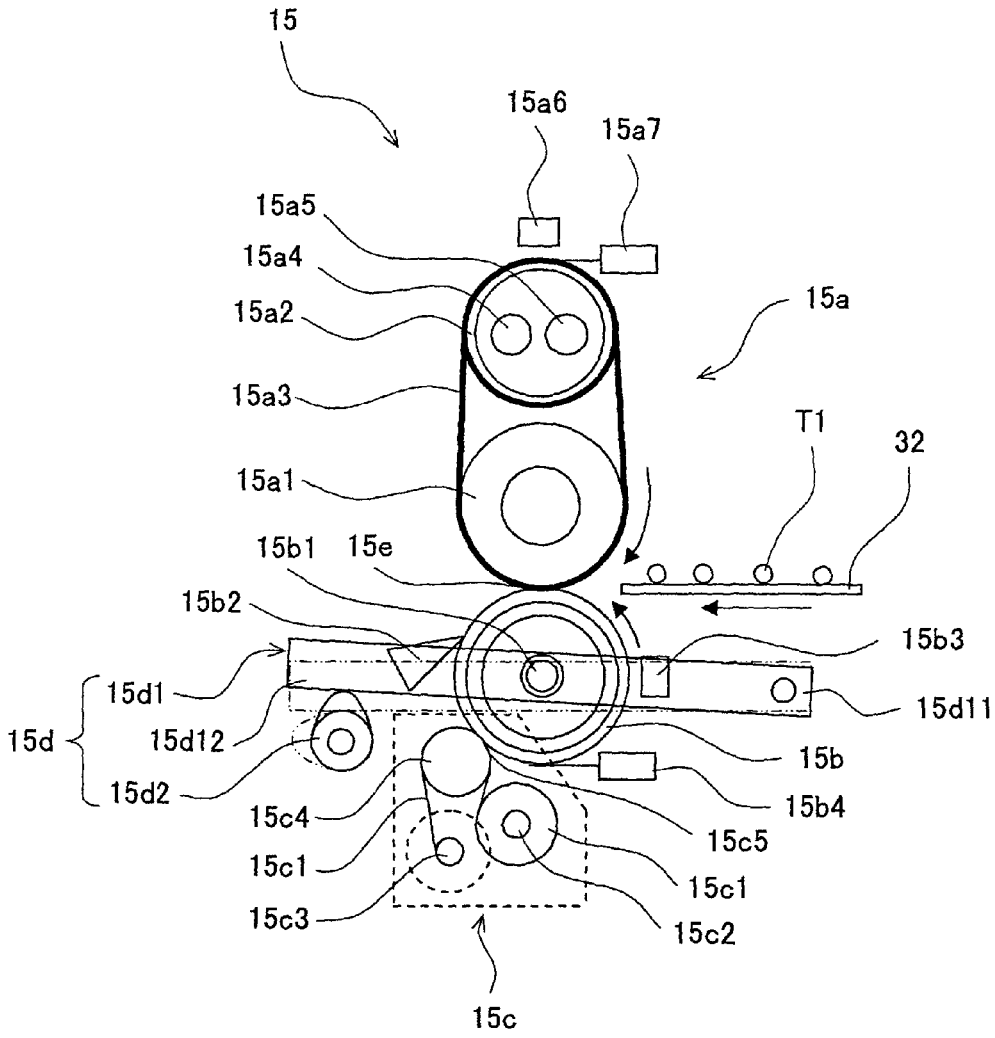
FIG. 3 is an illustrative diagram showing a state where a fixing belt and a pressing roller constituting the fixing device are in contact with each other.
Figure 4:
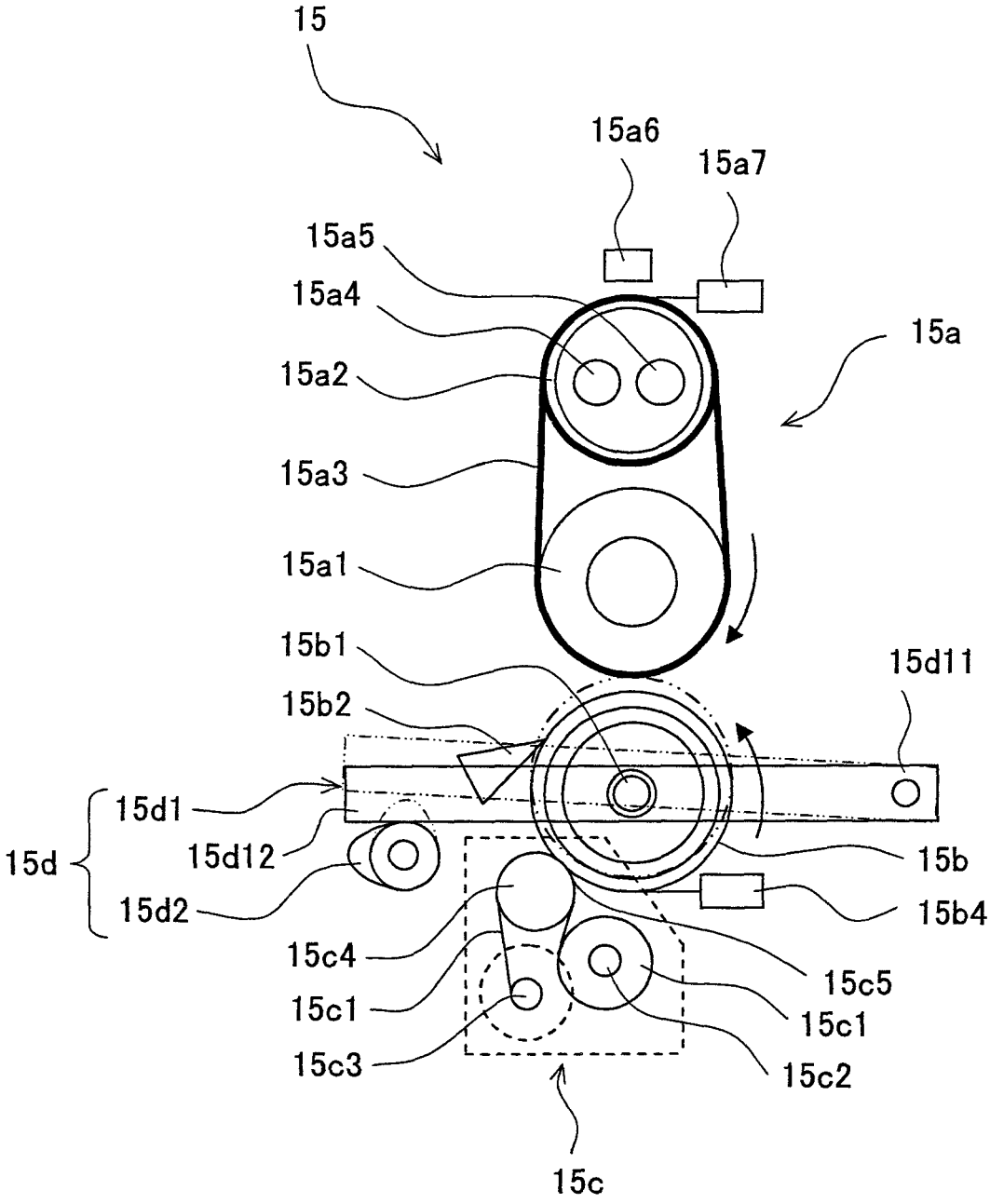
FIG. 4 is an illustrative diagram showing a state where the fixing belt is separated from the pressing roller.

FIG. 3 and FIG. 4 are illustrative diagrams showing the configuration of the fixing device 15, in which FIG. 3 is an illustrative diagram showing a state where a fixing belt and a pressing roller constituting the fixing device 15 are in contact with each other, and FIG. 4 is an illustrative diagram showing a state where the fixing belt separates from the pressing roller.

The fixing device 15 is equipped in the image forming apparatus 100 as shown in FIG. 2. The fixing device 15 is provide with, as shown in FIG. 3, a fixing portion 15*a*, a pressing roller 15*b*, a cleaning unit (cleaning portion) 15*c* and a contact/separation mechanism (contact/separation means) 15*d*, and fixes an unfixed toner image while conveying the recording sheet 32.

The fixing portion 15*a* is a device for heating and pressing a toner image T1 carried on the recording sheet 32 as a recording medium to fix onto the recording sheet 32. The fixing portion 15*a* is provided with a fixing roller 15*a*1 rotating freely, a heating roller 15*a*2 rotating freely, a fixing belt 15*a*3, looped over the fixing roller 15*a*1 and the heating roller 15*a*2, that heats and fuses the unfixed toner image on the recording sheet 32 to fix on the recording sheet 32.

The pressing roller 15*b* is provided at a position facing the fixing roller 15*a*1 via the fixing belt 15*a*3 so as to rotate freely and conveys the recording sheet 32 while pressing to the fixing belt 15*a*3.

The cleaning unit 15*c* is provided with a cleaning web (hereinafter, simply referred to as "web") 15*c*1 as a cleaning member impregnated with silicone oil that comes into contact with the pressing roller 15*b* to clean up the pressing roller 15*b*.

The contact/separation mechanism 15*d* bring the fixing portion 15*a* into contact with/separation from the pressing roller 15*b*.

That is, when the heating roller 15*a*2 comes into contact with the fixing belt 15*a*3 to heat the fixing belt 15*a*3, and the recording sheet 32 passes through the fixing nip portion 15*e* formed by the fixing belt 15*a*3 and the pressing roller 15*b* at a predetermined fixing speed and a copy speed, the fixing device 15 heats and presses, then fixes the unfixed toner image T1 carried on the recording sheet 32 onto the recording sheet 32.

Subsequently, the fixing device 15 sets viscosity of the silicone oil that impregnates the web 15*c*1 to 3,000 cs or more, and causes the contact/separation mechanism 15*d* to separate the fixing belt 15*a*3 from the pressing roller 15*b* at the time of rotation operation before fixation of the fixing belt 15*a*3 and the pressing roller 15*b* in preliminary operation performed before fixation operation, as shown in FIG. 4.

Here, the rotation before fixation means that the fixing belt 15*a*3 and the pressing roller 15*b* are rotated so that the fixing device 15 becomes a fixable state before performing the fixation operation at a fixing step (warming-up operation).

The fixing roller 15*a*1 and the heating roller 15*a*2 are arranged to be approximately parallel to each other along an axis direction of the fixing roller 15*a*1. That is, an axis of the fixing roller 15*a*1 and an axis of the heating roller 15*a*2 are disposed approximately parallel to each other. Thereby, the fixing belt 15*a*3 stretched out between the fixing roller 15*a*1 and the heating roller 15*a*2 is prevented from meandering at the time of rotation movement, and durability of the fixing belt 15*a*3 is able to be maintained over a long period of time.

Note that, the unfixed toner image T1 (FIG. 3) is formed of a developer (toner), for example, such as a nonmagnetic one-component developer (nonmagnetic toner), a nonmagnetic two-component developer (nonmagnetic toner and carrier) and a magnetic developer (magnetic toner).

Further, the fixing speed is, what is called, a process speed, and the copy speed is the number of copies per minute. Additionally, when the recording sheet 32 passes through the fixing nip portion 15*e*, the fixing belt 15*a*3 comes into contact with the surface of the recording sheet 32 on which the tone image is carried.

The heating roller 15*a*2 is formed of a thin, hollow, cylindrical shaft-like body made of metal such as aluminum, iron or the like, and revolvably engaged with respect to a fixed portion (not shown) such as an device frame via an unillustrated bearing. Inside the heating roller 15*a*2, halogen heaters (heat sources) 15*a*4 and 15*a*5 are provided in order to heat from the inside of the fixing belt 15a3. The halogen heaters (heat sources) 15a4 and 15a5 are not revolved, however, may be revolvable with the heating roller 15a2. The heating roller 15a2 may be configured so as not to revolve.

Moreover, near the outside of the heating roller 15a2 via the fixing belt 15a3, a thermostat 15a6 and a temperature sensor 15a7 that detects a surface temperature of the fixing belt 15a3 are arranged.

The fixing roller 15a1 comes into press-contact with the pressing roller 15b via the fixing belt 15a3, thereby forming the fixing nip portion 15e as well as conveying with an unillustrated driving motor (driving portion) the fixing belt 15a3 by rotationally driving in a rotation direction around a rotational axis.

The fixing roller 15a1 is formed of, for example, a columnar-shaped shaft-like body whose diameter is 30 mm, and composed of a double-layered structure formed of a metallic core and an elastic layer in the order from the inside to the outside. For the metallic core, for example, metal such as iron, stainless steel, aluminum, copper or alloys thereof is used. Further, for the elastic layer, a rubber material having heat-resistant such as silicone rubber or fluororubber is appropriate.

In the present embodiment, force when the fixing roller 15a1 comes into press-contact with the pressing roller 15b via the fixing belt 15a3 is approximately 216N.

The pressing roller 15b faces and comes into press-contact with the fixing roller 15a1 via the fixing belt 15a3, and is provided around the rotational axis so as to rotate freely. The pressing roller 15b is driven by the rotation of the fixing roller 15a1 to rotate in a rotational direction. Additionally, the pressing roller 15b is composed of a three-layer structure formed of a metallic core, an elastic layer and a release layer in the order from the inside to the outside. For the metallic core, for example, metal such as iron, stainless steel, aluminum, copper or alloys thereof is used. Further, for the elastic layer, a rubber material having heat resistance such as silicone rubber or fluororubber is appropriate, and for the release layer, a fluororesin such as a PFA (tetrafluoroethylene perfuluoroalkyl vinyl ether copolymer) or PTFE (polytetrafluoroethylene) is appropriate.

As the pressing roller 15b, for example, a roller whose roller diameter is 30 mm and in which an iron (STKM (carbon steel tubes for machine structural purposes) based on Japanese Industrial Standards: JIS G 3445) pipe whose diameter is 24 mm (thickness is 2 mm) is used for the metallic core, is able to be used, including silicone solid rubber whose thickness is 3 mm as an elastic layer in the outer circumferential portion, and covered with a PFA tube whose thickness is 30 μm as a release layer further outside.

Further, inside the pressing roller 15b, a halogen heater (for example, rated power: 400 W) 15b1 that heats the pressing roller 15b is arranged.

The halogen heater 15b1 is illuminated by power supplied (energization) from a power circuit (not shown) with an unillustrated device control portion, and infrared rays are emitted. Thereby, an inner circumferential surface of the pressing roller 15b absorbs the infrared rays to be heated, and the entire pressing roller 15b is heated. Note that, the above-described halogen heater 15b1 heats from the inner surface of the pressing roller 15b, however, other than that, a method of heating from the surface of the pressing roller 15b with a roller for heating the outer circumferential surface is able to be configured.

Near the outer circumferential portion of the pressing roller 15b, a peeling claw 15b2, a thermostat 15b3 and a temperature sensor 15b4 that detects a surface temperature of the pressing roller 15b are arranged.

The pressing roller 15b is provided with an arm 15d1 and a cam 15d2 as the contact/separation mechanism 15d that brings the fixing roller 15a1 into contact with/separation from the pressing roller 15b. The pressing roller 15b is rotatably held at an approximately center part of the arm 15d1.

The arm 15d1 has a one end side 15d11 pivotally supported as a fixing end, and has another end side 15d12 swingably provided by the cam 15d2 as a free end. The cam 15d2 is rotatably provided as well as in contact with the lower side of the another end side 15d12 of the arm 15d1 in FIG. 3.

As shown in FIG. 3 and FIG. 4, the cam 15d2 rotates by an unillustrated pressing motor and the another end side 15d12 performs rocking motion with the one end side 15d11 of the arm 15d1 as a supporting point, so that the contact/separation mechanism 15d displaces the pressing roller 15b in a vertical direction in FIG. 3.

That is, when the another end side 15d12 of the arm 15d1 is displaced upward, the pressing roller 15b comes into contact with the fixing belt 15a3, and when the another end side 15d12 is displaced downward, the pressing roller 15b separates from the fixing belt 15a3. This makes it possible to perform contact/separation between the pressing roller 15b held by the arm 15d1 and the fixing belt 15a3.

Note that, the contact/separation mechanism 15d that brings the fixing belt 15a3 into contact with/separation from the pressing roller 15b may be used in order to clear a pressure strain of the fixing roller 15a1 and the pressing roller 15b. In this case, there is no need to separately provide a mechanism for clearing the pressure strain of the fixing roller 15a1 and the pressing roller 15b, and it is possible to realize cost reduction of the device.

Moreover, near the pressing roller 15b, as a cleaning member, the cleaning unit 15c including a web 15c1 made of heat-resistant nonwoven fabric impregnated with silicone oil whose viscosity is 3,000 cs or more at 25° C., a delivery roller 15c2, a wind-up roller 15c3, and a press-contact roller 15c4 that is rotatable so as to come into press-contact with the surface of the fixing roller 15a1 via the web 15c1 is provided.

The cleaning unit 15c is composed of a unit structure integrally provided with the above-described members, and configured so as to be attachable/detachable with/from the fixing device 15 (specifically, with respect to the pressing roller 15b).

The web 15c1, insofar as the heat-resistant nonwoven fabric is used, is not particularly limited, and for example, includes nonwoven fabric including aromatic polyamide fibers and polyester fibers that soften at a high temperature and having both appropriate flexibility and mechanical strength. Such heat-resistant nonwoven fabric is commercially available, and for example, includes NOMEX (registered trademark), Himeron (registered trademark) and the like.

Further, the thickness of the web 15c1 is also not particularly limited, and is preferably 30 to 100 μm. In the present embodiment, a web material whose thickness is 40 μm is used.

Additionally, as silicone oil, silicone oil having 3,000 cs or more high viscosity at 25° C. is preferred to be used, and silicone oil used in this area includes, for example, dimethyl silicone oil, amino degeneration silicone oil, mercapto degeneration silicone oil, fluorine-modified silicone oil and the like. In the present embodiment, 3,000-cs silicone oil is impregnated at 25° C.

Note that, viscosity of the silicone oil is preferably 30,000 cs or less. In the case of exceeding 30,000 cs, an exuding amount of the silicone oil lessens, and there is no effect on the cleaning performance. When a coarse fiber mesh is used for the web in order to increase the exuding amount, toner collection performance as a web mechanical function is decreased.

Further, peeling properties of the recording sheet is inhibited when adhesive power of the silicone oil is too great, thus the fixable temperature range narrows, and in the case of performing continuous printing, the temperature of the fixing roller is lowered so that the recording sheet is wound on the fixing roller, or a paper jam is occurred, which poses a problem.

The delivery roller 15*c*2 is supported around the axis so as to be able to be driven to rotate.

The wind-up roller 15*c*3 is provided around the axis by an unillustrated driving portion so as to be driven to rotate.

The web 15*c*1 delivered from the delivery roller 15*c*2 is brought into contact with the surface of the pressing roller 15*b* by the press-contact roller 15*c*4, and thereafter rewound by the wind-up roller 15*c*3.

Next, description will be given for operation of the cleaning unit 15*c*.

The cleaning unit 15*c* is subjected to operational control by an unillustrated CPU.

The CPU, after detecting by an unillustrated sensor, the number of rotations of the fixing roller 15*a*1 and the like that a predetermined number of recording sheets 32 has passed through the fixing nip portion 15*e*, sends a control signal to an unillustrated driving portion that rotates the wind-up roller 15*c*3.

The driving portion that receives the control signal rewinds a certain amount of the web 15*c*1 by rotating the wind-up roller 15*c*3. Such rewinding operation allows the web 15*c*1 to be delivered from the delivery roller 15*c*2, and the web 15*c*1 that reaches a cleaning nip portion (a press-contact portion of the pressing roller and the web) 15*c*5 adsorbs an offset toner that adheres to the surface of the pressing roller 15*b* as well as supplies oil to the pressing roller 15*b*.

Note that, although the present embodiment shows an operation example of intermittent rewinding performed by the wind-up roller 15*c*3, rewinding operation of the web 15*c*1 by the wind-up roller 15*c*3 is not limited thereto, and it may be configured to continuously rewind the web 15*c*1 in time with a timing when the recording sheet 32 passes through the fixing nip portion 15*e*.

The press-contact roller 15*c*4 is a roller-shaped member whose both ends in a longitudinal direction (axial direction) are fitted in unillustrated bearings so as to be able to be driven to rotate and provided so as to be brought into press-contact with the surface of the pressing roller 15*b* via the web 15*c*1 by an unillustrated pressing portion. Then, the press-contact roller 15*c*4 is driven to rotate at the time of the rewinding operation of the web 15*c*1 by the wind-up roller 15*c*3. The press-contact portion of the press-contact roller 15*c*4 and the pressing roller 15*b* is the cleaning nip portion 15*c*5.

For the press-contact roller 15*c*4, for example, a roller-shaped member containing a metallic core and an elastic layer formed on the surface of the metallic core is used. An elastic member constituting the elastic layer includes, for example, foam of heat-resistant rubber such as silicone rubber.

Note that, surface hardness of the elastic layer of the press-contact roller 15*c*4 is not particularly limited, however, is preferably 20° to 30° (Asker-C hardness of standards of The Society of Rubber Industry, Japan).

Further, pressing force of the press-contact roller 15*c*4 to the pressing roller 15*b* is preferably 3,793.6 Pa (0.039 kgf/cm$^2$) to 18,967.9 Pa (0.19 kgf/cm$^2$).

When the pressing force of the press-contact roller 15*c*4 to the pressing roller 15*b* is less than 3,793.6 Pa, there is a possibility that an offset toner leaks into the inside of the image forming apparatus 100. On the other hand, when the pressing force of the press-contact roller 15*c*4 to the pressing roller 15*b* exceeds 18,967.9 Pa, a surface layer of the pressing roller is easily damaged, and there is a possibility that a fixation defect of an image occurs.

For the pressing portion that presses the press-contact roller 15*c*4 to the pressing roller 15*b*, for example, a spring member or the like is used. It is preferable that a width of the press-contact roller 15*c*4 in a longitudinal direction (axial direction) is wider than a maximum width of an image forming area to be formed in the image forming apparatus 100.

Moreover, the width of the cleaning nip portion 15*c*5 (cleaning nip width) is preferred to be designed in an appropriate range since a huge effect is given on the cleaning performance of the cleaning unit 15*c*. Additionally, the cleaning nip width is determined mainly according to the pressing force of the press-contact roller 15*c*4 to the pressing roller 15*b*, a roller diameter of the press-contact roller 15*c*4 and the like.

In the present embodiment, the image forming area is set to 290 mm, the width of the press-contact roller 15*c*4 in a longitudinal direction is set to 310 mm which is longer than that of the image forming area, the roller diameter is set to 20 mm, and the cleaning nip width is set to 5 mm.

In this case, as shown in FIG. 2, at the time of the fixation operation in which the fixing belt 15*a*3 comes into contact with the pressing roller 15*b*, the silicone oil supplied from the web 15*c*1 is applied to the pressing roller 15*b* so as to be a silicone oil amount required for cleaning. The applied silicone oil is transferred to the recording sheet 32, and thus keeps an appropriate amount.

On the other hand, even when the silicone oil is applied in the appropriate amount in transfer operation, in a case where the fixing belt 15*a*3 is in contact with the pressing roller 15*b* all the time, the silicone oil applied to the pressing roller 15*b* is transferred and moved to the fixing belt 15*a*3 at the time of a preceding rotation such as warming-up, so that a large amount of the silicone oil is applied to the fixing belt. As a result, viscosity properties of the high-viscosity silicone oil that is used with an aim to prevent contamination in the device causes decrease in the peeling properties of the recording sheet 32 to narrow the fixable range, and posing a problem that the degradation of image occurs.

However, like the present embodiment, the fixing belt 15*a*3 is separated from the pressing roller 15*b* at the time of the preceding rotation such as the time of warming-up, so that it is possible to prevent a large amount of the high-viscosity silicone oil from moving to the fixing belt 15*a*3, and to maintain the peeling properties of the recording sheet 32.

Further, the cleaning unit 15*c* is integrally provided as a unit so as to be attachable to/detachable from the fixing device 15. Therefore, according to the present embodiment, the cleaning unit 15*c* containing the web 15*c*1 is designed so as to be attachable to/detachable from the fixing device 15 so that it becomes easy to change the web 15*c*1 and parts maintenance cost becomes decreased.

Additionally, in a case where the silicone oil contamination occurs, the leaked silicone oil is able to be kept inside the cleaning unit 15*c*, and it is thus possible to prevent from expanding contamination into the fixing device.

The fixing belt 15*a*3 is heated to a predetermined temperature by the heating roller 15*a*2, and heats the recording sheet 32 with an unfixed toner image formed thereon that passes through the fixing nip portion 15*e*. The fixing belt 15*a*3 which is an endless belt is suspended by the heating roller 15*a*2 and the fixing roller 15*a*1, and wound around the fixing roller 15*a*1 at a predetermined angle. Then, at the time of rotation of the fixing roller 15*a*1, the fixing belt 15*a*3 is driven by the fixing roller 15*a*1 and rotates in a rotational direction.

The fixing belt 15*a*3 is configured to have a three-layer structure that an elastomer material excellent in heat resistance and elasticity as an elastic layer (for example, silicone rubber) is formed on the surface of a (flexible) hollow cylindrical base material made of heat-resistant resin such as polyimide or a metallic material such as stainless-steel, nickel or the like, and further on the surface thereof, a fluororesin material excellent in heat resistance and release properties (for example, fluororesin such as a PFA, PTFE or the like) is formed as a release layer.

The surface layer of the fixing belt 15*a*3 is preferred to be formed of a tube made of a fluororesin. A tube is used as a coating material, so that it is possible to secure stable release properties, and with favorable durability and abrasion resistance, it is possible to have a long operating life. Additionally, carbon black or the like may be added into polyimide of the base material. This makes it possible to prevent charging of the fixing belt 15*a*3 and reduce electrostatic offset.

The temperature sensors 15*a*7 and 15*b*4 are, for example, composed of thermistors, detect temperatures of the fixing belt 15*a*3 and the pressing roller 15*b*, respectively, and an unillustrated control portion controls a heat source of the heating roller 15*a*2 (halogen heaters 15*a*4 and 15*a*5) and a heat source of the pressing roller 15*b* (halogen heater 15*b*1), respectively, based on the detection result.

Further, in the case of occurrence of a trouble in a control system, the heat sources of the heating roller 15*a*2 and the pressing roller 15*b* go out of control and are very dangerous. In order to prevent such a case, in the present embodiment, near the circumferential surfaces of the fixing belt 15*a*3 and the pressing roller 15*b*, thermal protectors such as the thermostats 15*a*6 and 15*b*3 are disposed for detecting abnormal rising temperatures of the fixing belt 15*a*3 and the pressing roller 15*b* and disconnecting a power circuit in the case of exceeding a predetermined temperature.

Next, description will be given for electrical control in the fixing device 15.

In the fixing device 15, based on temperature data detected by the temperature sensor 15*a*7 on the side of a heating element and the temperature sensor 15*b*4 on the side of the pressing roller, and abnormal rising temperature data of the fixing belt 15*a*3 and the pressing roller 15*b* detected by the thermal protectors, a control circuit as a temperature control portion controls power supply to a heat generation member having a heating member as well as halogen heaters 15*a*4, 15*a*5 and 15*b*1, via the power circuit, so as to set the surface temperatures of the fixing belt 15*a*3 and the pressing roller 15*b* to a predetermined temperature.

Furthermore, the control circuit controls a driving motor to rotate the fixing roller 15*a*1 around a rotation axis, then rotates the fixing belt 15*a*3. Subsequently, the control circuit and the power circuit are comprehensively controlled by a device control portion that controls all operation of the fixing device 15.

Specifically, the device control portion outputs a control signal that instructs power supply to the power circuit when receiving an input of an image formation instruction. Here, the image formation instruction is an instruction that is input from an operation panel for a user (not shown) provided on the upper surface of the image forming apparatus 100 in a vertical direction or an external device such as a computer connected to the image forming apparatus 100, and the image formation instruction is input, and the fixing device 15 thereby starts fixation processing operation.

The power circuit in which the control signal is input from the device control portion supplies power to heat sources of the heating roller 15*a*2 and the pressing roller 15*b* (halogen heaters 15*a*4, 15*a*5 and 15*b*1) via a power control portion to heat the fixing belt 15*a*3 and the pressing roller 15*b*.

The control circuit, when judging based on the input signal that surface temperatures of the fixing belt 15*a*3 and the pressing roller 15*b* become a predetermined fixing temperature, brings the fixing belt 15*a*3 into contact with the pressing roller 15*b* with a pressure release mechanism, further controls the driving motor, rotates the fixing roller 15*a*1 around a rotational axis, and rotates the fixing belt 15*a*3.

When the fixing belt 15*a*3 is rotated in this manner, the recording sheet 32 on which an unfixed toner image is formed is conveyed to the fixing nip portion 15*e* formed between the fixing belt 15*a*3 and the pressing roller 15*b*. At the time, the recording sheet 32 is conveyed so that the surface thereof on which the unfixed toner image is carried faces the side of the fixing belt 15*a*3. Then, the unfixed toner image on the recording sheet 32 is conveyed by being held in close contact with the outer circumferential surface of the fixing belt 15*a*3, so that heat is imparted from the fixing belt 15*a*3, and is fixed to the surface of the recording sheet 32 by receiving applied pressure.

Next, description will be given for effects of examples and comparative examples of the fixing device 15 of the present embodiment with reference to a table. FIG. 5 is a table that compares effects of the examples and the comparative examples of the fixing device of the present embodiment.

As shown in FIG. 5, in the fixing device 15, by changing conditions of the configuration of the fixing belt 15*a*3, the contact/separation state between the fixing belt 15*a*3 and the pressing roller 15*b*, viscosity of the silicone oil that impregnates the web 15*c*1 and a fixation range (fixing temperature), effects and a determination result concerning cleaning properties and contamination inside the device were compared.

Example 1

Example 1 is to cover the surface layer of the fixing belt 15*a*3 with a tube of the PFA, separate the fixing belt 15*a*3 from the pressing roller 15*b*, set the viscosity of the silicone oil to 3,000 cs and set the fixing temperature to 40° C.

According to the Example 1, even for 200 k (×1000) sheets, both image contamination and contamination inside the device did not occur.

Example 2

Example 2 is to coat the surface layer of the fixing belt 15*a*3 with the PFA, separate the fixing belt 15*a*3 from the pressing roller 15*b*, set the viscosity of the silicone oil to 3,000 cs and set the fixing temperature to 50° C.

According to the Example 2, even for 200 k (×1000) sheets, both image contamination and contamination inside the device did not occur.

Comparative Example 1

Comparative Example 1 is to cover the surface layer of the fixing belt 15*a*3 with a tube of the PFA, separate the fixing belt 15*a*3 from the pressing roller 15*b*, set the viscosity of the silicone oil to 300 cs and set the fixing temperature to 40° C.

According to the Comparative Example 1, even for 10 k (×1000) sheets, image contamination and contamination inside the device occurred.

Comparative Example 2

Comparative Example 2 is not to cover the surface layer of the fixing belt 15*a*3 with a tube of the PFA, in the state where the fixing belt 15*a*3 is in contact with the pressing roller 15*b*, set the viscosity of the silicone oil to 3,000 cs and set the fixing temperature to 25° C. or less.

According to the Comparative Example 2, even for 5 k (×1000) sheets, image contamination occurred, and the image quality was deteriorated due to defects of the peeling properties.

According to the results of the Examples 1, 2 and the Comparative Examples 1, 2 described above, it was found that in the fixing device 15, in a state where the fixing belt 15*a*3 is separated from the pressing roller 15*b*, the viscosity of the silicone oil that impregnates the web 15*c*1 is set to 3,000 cs, so that a favorable image is able to be obtained without occurrence of image contamination and contamination inside the device.

As described above, the fixing device 15 of the image forming apparatus 100 is configured to be provided with the cleaning unit 15*c* including the web 15*c*1 impregnated with silicone oil that comes into contact with the pressing roller 15*b* to clean up the pressing roller 15*b*, set the viscosity of the silicone oil of the web 15*c*1 to 3,000 cs or more, include the contact/separation mechanism 15*d* that brings the fixing belt 15*a*3 into contact with/separation from the pressing roller 15*b*, and separate the fixing belt 15*a*3 from the pressing roller 15*b* at the time of rotation operation before fixation. The fixing device 15 prevents the high-viscosity silicone oil that impregnates the web 15*c*1 from moving to the fixing belt 15*a*3 with such a simple configuration to seek improvement of the cleaning properties of the pressing roller 15*b*, and without image contamination, it is possible to suppress contamination caused by the silicone oil inside the device and favorably maintain the peeling properties of the recording sheet 32. This makes it possible to form a uniform and high quality image on the recording sheet 32.

Additionally, since the cleaning unit 15*c* does not retain extra heat capacity, the fixing device 15 is able to shorten the warming-up time until obtaining a predetermined fixing temperature, so that it is possible to realize a fixing device that lessens power consumption to seek energy conservation.

Note that, in the present embodiment, the contact/separation mechanism 15*d* provided with the arm 15*d*1 and the cam 15*d*2 for operating the pressing roller 15*b* is employed as contact/separation means that brings the fixing portion 15*a* into contact with/separation from the pressing roller 15*b*, however, the present invention, insofar as the fixing portion 15*a* is able to be brought into contact with/separation from the pressing roller 15*b*, is not limited to a configuration of the contact/separation means.

Hereinbefore, in the above-described embodiment, description has been given for an example that applies the configuration of an image forming apparatus according to the present invention to the image forming apparatus 100 as shown in FIG. 2, however, insofar as the image forming apparatus includes the fixing device using the heating portion and the pressing roller, the present invention is not limited to the image forming apparatus with the above-described configuration, therefore it is possible to develop to an image forming apparatus with the other configuration or the like. For example, it is applicable also to an image forming apparatus configured so as to press the heating roller as the heating portion directly to the pressing roller.

As described above, the present invention is not limited to the above-described embodiment, and is allowed to have various changes in the scope shown in the claims. That is, even embodiments obtained in combination with technical means to be changed as appropriate without departing from the spirit of the present invention are included in the technical range of the present invention.

What is claimed is:

1. A fixing device that fixes an unfixed toner image to a recording medium while conveying the recording medium, comprising:

a fixing portion;

a pressing roller;

a cleaning portion; and a contact/separation mechanism, wherein the fixing portion includes:

a fixing roller so as to rotate freely;

a heating roller; and a fixing belt that is looped over the fixing roller and the heating roller and heats and fuses the unfixed toner image on the recording medium to fix onto the recording medium, the pressing roller is provided at the position facing the fixing roller via the fixing belt so as to rotate freely and conveys the recording medium while pressing to the fixing belt, the cleaning portion comprises a cleaning member impregnated with silicone oil that comes into contact with the pressing roller to clean up the pressing roller, the contact/separation mechanism brings the fixing portion into contact with/separation from the pressing roller, viscosity of the silicone oil is 3,000 cs or more, and while the cleaning portion remains in contact with the pressing roller, the contact/separation mechanism separates the fixing belt and the pressing roller during preliminary rotation of the fixing belt and the pressing roller in preparatory operation before fixing, and wherein the fixing belt has a multilayered structure, and the surface layer of the fixing belt is formed of a fluororesin tube, and wherein the cleaning member is formed of a web material made of a heat-resistant nonwoven fabric.

2. The fixing device according to claim 1, wherein the cleaning member is formed of a web material made of a heat-resistant nonwoven fabric.

3. The fixing device according to claim 2, wherein the cleaning portion is composed of a unit comprising a delivery portion that delivers the cleaning member, a wind-up portion that rewinds the cleaning member, and a press-contact roller that is rotatable to come into press-contact with the surface of the pressing roller via the cleaning member, and the cleaning portion is configured to be attachable to and detachable from the fixing device.

4. The fixing device according to claim 1, wherein the cleaning portion is composed of a unit comprising a delivery portion that delivers the cleaning member, a wind-up portion that rewinds the cleaning member, and a press-contact roller that is rotatable to come into press-contact with the surface of the pressing roller via the cleaning member, and the cleaning portion is configured to be attachable to and detachable from the fixing device.

5. An image forming apparatus that forms an image using a toner with electrophotography comprising:

a photoreceptor drum on whose surface an electrostatic latent image is formed;

a developing device that supplies a toner to the electrostatic latent image on the surface of the photoreceptor drum to form a toner image;

a transfer device that transfers the toner image on the surface of the photoreceptor drum to a recording medium; and a fixing device that fixes the transferred toner image to the recording medium, wherein the fixing device according to claim 1 is used as the fixing device.

* * * * *